US005732641A

United States Patent [19]

Kawasaki

[11] Patent Number: 5,732,641

[45] Date of Patent: Mar. 31, 1998

[54] SYSTEM FOR SEWING AN ANCHOR MEMBER TO A COVERING MATERIAL OF VEHICLE SEAT

[75] Inventor: Kiyoshi Kawasaki, Akishima, Japan

[73] Assignee: Tachi-S Co., Ltd., Tokyo, Japan

[21] Appl. No.: 838,028

[22] Filed: Apr. 22, 1997

[51] Int. Cl.[6] ..... D05B 21/00; D05B 33/00

[52] U.S. Cl. ..... 112/470.07; 112/470.27; 112/470.33; 112/475.07; 112/152

[58] Field of Search ..... 112/470.07, 470.06, 112/470.27, 470.33, 470.14, 470.36, 320, 475.07, 475.08, 152, 470.01

[56] References Cited

U.S. PATENT DOCUMENTS

| | | | |
|---|---|---|---|
| 4,353,539 | 10/1982 | Doyen et al. | 112/470.06 X |
| 4,708,072 | 11/1987 | Frye | 112/152 X |
| 4,899,674 | 2/1990 | Kawasaki . | |
| 4,913,071 | 4/1990 | Kawasaki . | |
| 4,928,609 | 5/1990 | Kawasaki . | |
| 5,315,946 | 5/1994 | Howell et al. | 112/475.07 X |
| 5,560,308 | 10/1996 | Eto | 112/470.07 |
| 5,626,091 | 5/1997 | Kobayashi . | |

*Primary Examiner*—Peter Nerbun
*Attorney, Agent, or Firm*—Browdy and Neimark

[57] ABSTRACT

A sewing system which permits automated sewing of an anchor member to a covering material. By operation of this sewing system, the covering material is transferred by associated vertical and horizontal transfer mechanisms to a sewing position adjacent to a sewing machine, and then, the anchor member is supplied by the associated supply mechanism to a sewing start point at the sewing machine. The sewing machine operates to sew together the anchor member and covering material from that sewing start point to form a resulting sewn product of an anchor member and a covering material, after which, the resulting sewn product is discharged from the system to a discharging area. Also, the sewing system has a mechanism to adjustably locate and set the covering material at the sewing start point according to the length of the covering material. Further, an arrangement is provided for adjustably permitting supply of different lengths of anchor members to the sewing start point, for proper sewing with the covering member.

20 Claims, 5 Drawing Sheets

SYSTEM FOR SEWING AN ANCHOR MEMBER TO A COVERING MATERIAL OF VEHICLE SEAT

BACKGROUND OF INVENTION

1. Field of the Invention

The present invention relates to a sewing system suited for automatically sewing an anchor member of synthetic resin with a covering material which forms a part of a vehicle seat.

2. Description of Prior Art

In assembling a vehicle or automotive seat, a covering material or trim cover assembly is finally affixed on an upholstery and frame of the seat to provide an improved profile and touch of seat. It is a recent practice to employ an anchor member for facilitating the ease of securing the covering material to a seat frame, so that a worker can simply stretch the covering material over a body of seat and directly secure the peripheral ends of covering material to a securing part of seat frame via the anchor member, at a final step to complete upholdering of seat.

An example of such anchor member is shown at (B) in FIGS. 1 to 3. Referring now to the FIGS. 1 to 3, and in particular to FIG. 1, there is shown a seat back (SB) which forms a part of vehicle or automotive seat. Seat back (SB) is of a known ordinary construction comprising a seat back frame (103), a foam padding or cushion member (104) and a covering material (A). As shown, the covering material (A) is stretched on the foam cushion member (104), covering the whole frontal side of the same, and secured at one terminal end (at A1-*e*) thereof, via an anchor member (B), to a securing member (103A) (a wire or rod) fixed to the seat back frame (103).

As shown in FIGS. 2 and 3, the anchor member (B) is formed from a synthetic resin material in an "L" shape, having a protuberant connecting end portion (Be1). On the other hand, the covering material (A) has an upwardly folding cover section (A1) which is folded about the seat back frame (103) upwardly at the rear side of seat back (SB). Such upwardly folding cover section (A1) is sewn with the covering material (A) at one end thereof, and, as shown in FIG. 2, is further provided with the anchor member (B). Specifically, the anchor member (B) is fixedly connected by sewing, at its base end portion (Be2), to and along the free terminal end (A1-*e*) of the upwardly folding cover section (A1), in such a manner that the body of anchor member (B) lies on the gigged or raised outer surface (a) of cover section (A1), with the connecting end portion (Be1) thereof projecting upwardly, as shown in FIG. 3. Designation (B1) denotes a seam or thread along which the anchor member (B) is sewn with that cover section (A1). Thus, the member (B) can be folded about the thread (B1) in a direction outwardly of the cover section (A1), as indicated by the two-dot chain line in FIG. 3. As shown in FIG. 1, the cover section (A1) is adapted to cover a mating upwardly folding end portion of cushion member (104). Accordingly, in assembly of the seat back (SB), the lamination of both cover section (A1) and folding end portion of cushion member (A) is first secured about the lower frame section of seat back frame (103) and finally anchored to the securing wire (103A) via the anchor member (B) and hog ring (HR).

With regard to the upwardly folding section (A1), it has been a hitherto common practice for a worker to directly place the anchor member (B) in position thereon with his or her hands and sew them together, as in FIG. 2, by use of a sewing machine. As a result of this manual work, nervous concentration and annoying labor are required at the worker's side to sew each anchor member (B) precisely at a given position of each cover section (A1), which makes slow and inefficient the flow of all working processes involved.

SUMMARY OF THE INVENTION

In view of the above-stated problems, it is therefore a primary purpose of the present invention to provide a sewing system which permits for automated sewing of an anchor member to a covering material for use on a vehicle seat.

In order to achieve such purpose, the sewing system in accordance with the present invention is basically comprised of:

a base means;

a sewing machine provided on the base means, the sewing machine having a sewing needle and a feeder means;

an anchor member supply mechanism provided on the base means, the anchor member supply mechanism including:

- a carriage means on which a plurality of the anchor members are to be placed abreast with one another, which carriage means is operable to introduce one of those plural anchor members to a feed position oriented toward the sewing needle and feeder means of the sewing machine; and
- a thruster means for thrusting such one of the anchor members, at the feed position, in a direction toward a sewing start point adjacent to the sewing needle feeder means of sewing machine;

a covering material storage means for storing a plurality of the covering materials therein in a vertically piled manner, the covering material storage means being provided laterally of and below the base means, and including a biasing means for resiliently biasing those plural covering materials in an upward direction, wherein a biasing force of the biasing means is so adjusted as to tend to raise the plural covering materials progressively as one of the plural covering materials is removed from the covering material storage means, such as to insure that an uppermost one of the plural covering materials is always positioned at a fixed level;

a vertical transfer mechanism provided at the base means, the vertical transfer mechanism being operable vertically towards and away from said covering material storage means so as to catch the uppermost one of plural covering materials, to thereby secure one covering material from the plural covering materials, and then transfer such one covering material upwardly from the covering material storage means to a level above the base means;

a horizontal transfer mechanism provided at the base means in vicinity of the sewing machine, the horizontal transfer mechanism being operable horizontally between the vertical transfer mechanism and the sewing machine so as to receive one covering material from the vertical transfer mechanism and then transfer the same to a sewing position where the sewing needle and feeder means of sewing machine are disposed; and a discharging mechanism provided at one end portion of the base means, the discharging mechanism including a discharging area disposed outside the base means.

Accordingly, one covering material is transferred by operation of the vertical and horizontal transfer mechanisms from the plural covering materials to the sewing position, and then one anchor member is thrust from the plural anchor members by operation of the thruster means to the sewing start point. Then, operation of the sewing machine causes the anchor member to be sewn with the covering material from the sewing start point to produce a resulting sewn product of covering material and anchor member, and operation of the discharging mechanism causes such resulting sewn product to be discharged out of the base means to the discharging area.

It is a second purpose of the present invention to permit for sewing a different length of the anchor member to the covering member.

For that purpose, an adjustment means may be provided to enable adjusting a position of the thruster means according to a different length of said anchor member, so that the different length of anchor member may be precisely thrust and fed by the thruster means to the foregoing sewing start point. Preferably, the thruster means may comprise a thurster cylinder, and the adjustment means may comprise a cylinder and a slide means, such that a cylinder rod of the cylinder is connected, via the slide means, to the thruster cylinder.

It is a third purpose of the present invention to permit for adjustably locating and setting the covering material at a proper sewing position according to the length thereof.

For that purpose, a covering material locating/setting mechanism may be arranged on the base means such as to be disposed in the neighborhood of the sewing machine and at one part of the horizontal transfer mechanism. This locating/setting mechanism is operable to cause normal and reverse displacement of the foregoing one covering material which has been transferred to the sewing position by the horizontal transfer mechanism, to thereby determine a length of the covering material, and then locate and set the same covering material at a proper position according to the length thereof, so that the covering material is sewn with the anchor member from the sewing start point. Preferably, this mechanism may comprise a sensor means for detecting one end of the one covering material transferred by the horizontal transfer mechanism to the sewing position, the sensor means being provided at a point adjacent to the transfer mechanism and at a predetermined distance from the sewing start point, a roller means for feeding the covering material in a direction toward and away from the sensor means; and a motor operable normally and reversely to actuate the roller means so as to feed the covering material in that direction. Thus, one end of the covering material may be detected by the sensor means to determine the length of covering member, and responsive to the detection of sensor, the motor is operated reversely to feed the covering material towards the proper position according to the length of the same covering material.

Other features and advantages of the invention will become apparent from reading the descriptions hereinafter, with reference to the annexed drawings.

DETAILED DESCRIPTION OF PREFERRED EMBODIMENTS OF THE INVENTION

Referring to FIGS. 4 through 11, there is illustrated one preferred example of a sewing system in accordance with the present invention, which is generally designated by (SM), having mechanisms operable to permit for an unmanned, automated sewing of the abovementioned anchor member (B) to a cover section (e.g designated by (A1)) of covering material (A) for use on a vehicle or automotive seat. Hereinafter, such cover section shall be merely referred to as a "covering material" and designated by (A1). For, the covering material (A1) is not limited to the illustrated one, but may be of any other shape, including a whole or part of covering material for use on a vehicle seat, insofar as it is suited for sewing with the anchor member (B) by the present system (SM). Of course, the anchor member (B) is not limited to the illustrated one, either, but may be of any other shape suited for anchoring the covering material (A1) to the seat back frame (103).

Figure 4:
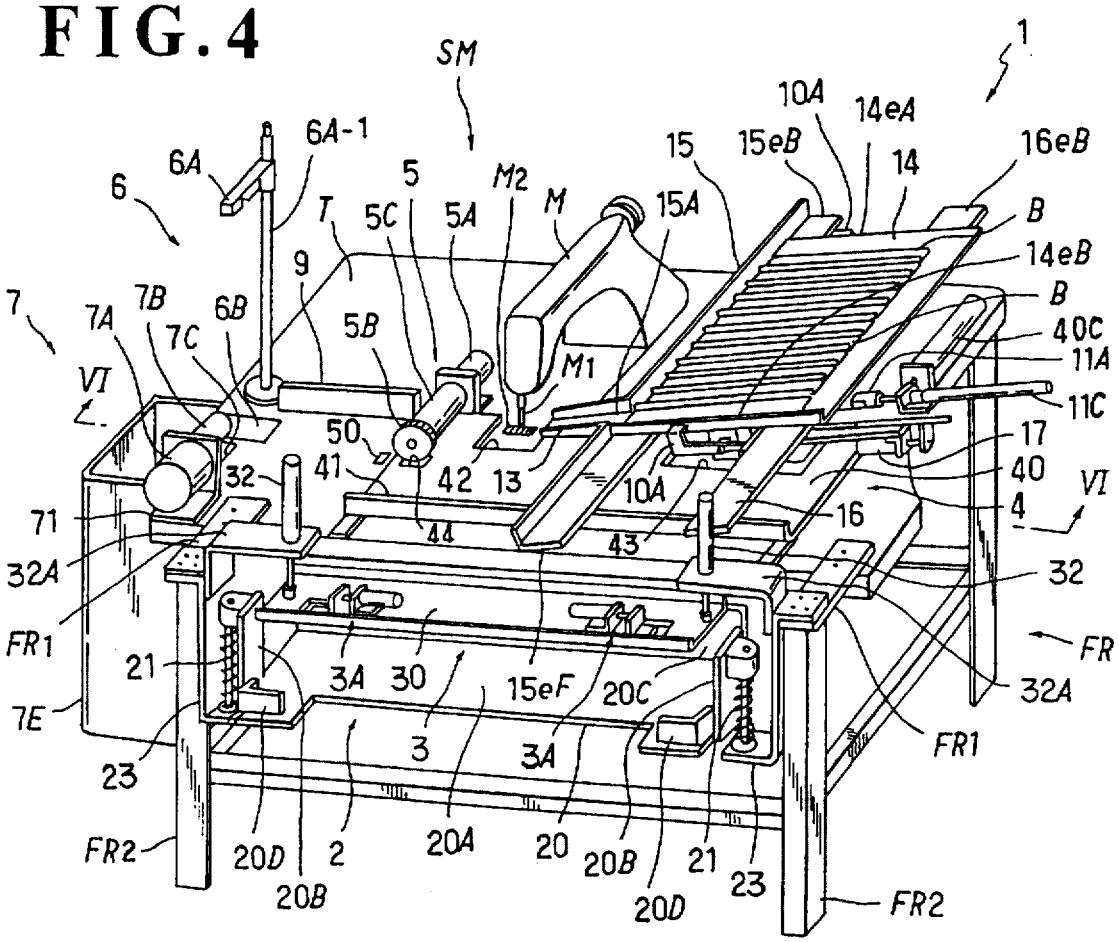
FIG. 4 is a perspective view of a sewing system for sewing the anchor member to the covering material in accordance with the present invention.
Figure 5:
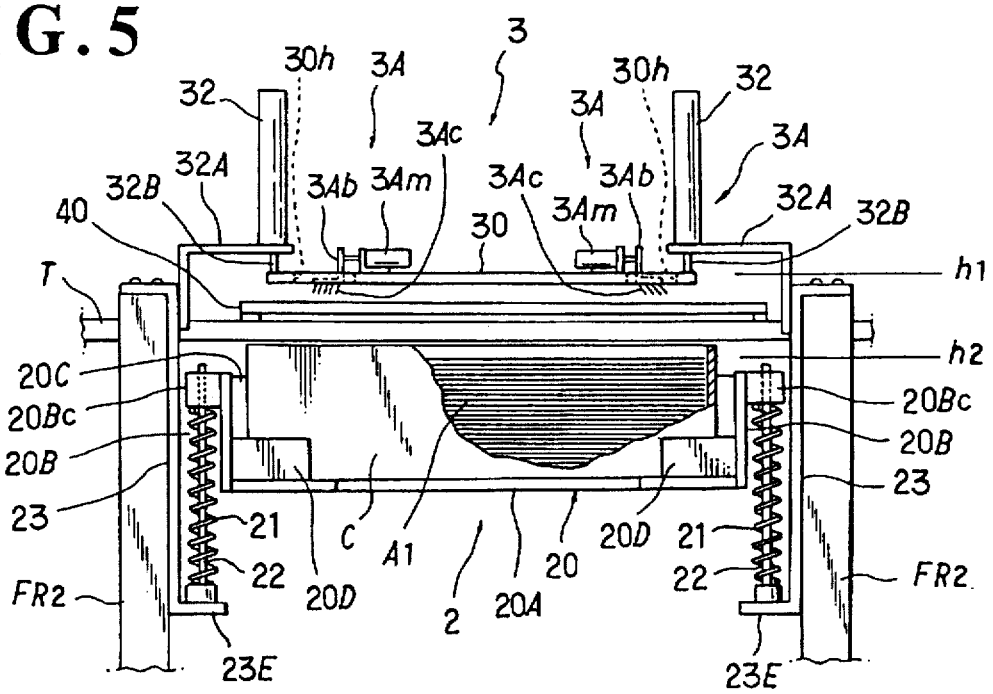
FIG. 5 is a partly broken front view of the sewing system, which particularly shows a covering material storage device and a vertical transfer mechanism.
Figure 6:
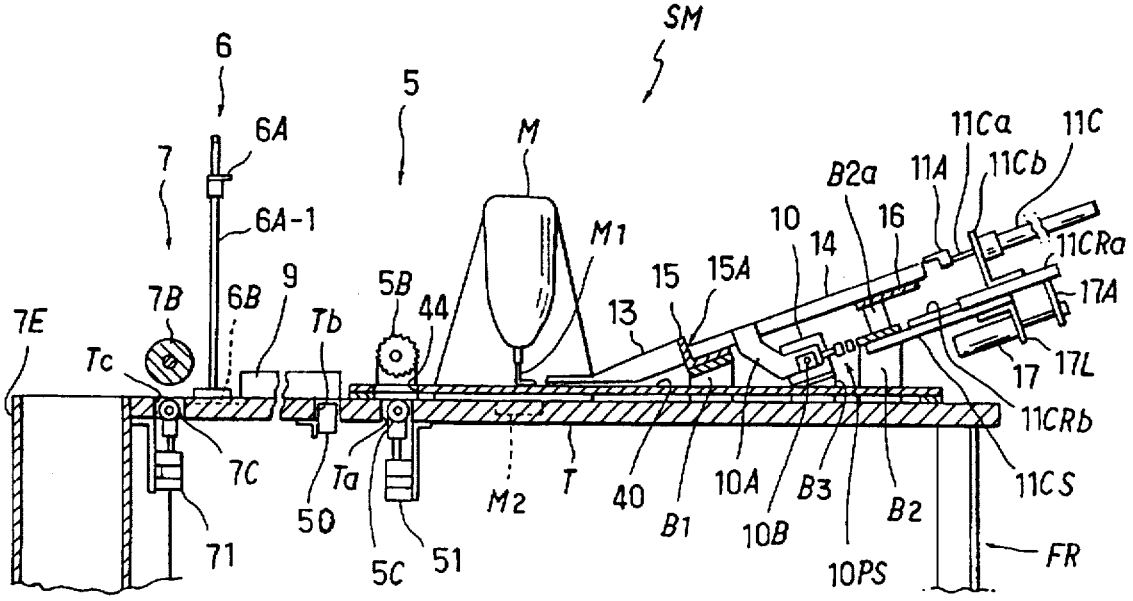
FIG. 6 is a partly broken sectional view taken along the line VI—VI in FIG. 4.

As can be seen from FIGS. 4, 5 and 6, the sewing system (SM) is essentially composed of: an anchor member supply mechanism (1); a covering material storage device (2); a vertical transfer mechanism (3); a horizontal transfer mechanism (4); a locating/setting mechanism (5); a sewing machine (M); a stop detector (6); and a discharging mechanism (7). Those mechanical elements are all mounted upon a base framework (FR) and table (T).

The sewing machine (M) used in this system is a known ordinary sewing machine having a sewing needle (M1) with a press guide piece, and a toothed feeder (M2).

Although not shown, all the mechanisms to be described in this sewing system may be controlled in their respective operations by a computer and therefore may be electrically connected thereto for fully automated actions under a certain program prepared according to a flow of operations that will be described later with particular reference to FIGS. 7 to 12.

The anchor member supply mechanism (1) includes a carriage plate (14) upon which plural anchor members (B) are placed abreast with one another, and a drive source (10, 10A, 10B) for causing the carriage plate (14) to move in a direction transversal with the table (T). A predetermined set of the anchor members (B) (20 pieces for example) are initially brought by a conveyer belt line (not shown) to that carriage plate (14). Carriage plate (14) is slidably supported on a pair of spaced-apart first and second guide support members (15)(16) in an inclined fashion, such that one lateral side of carriage plate (14) is directed downwardly towards a central area of table (T) where the sewing machine (M) is disposed. In this respect, as best shown in FIG. 6, the first guide support member (15), which has a an L-shaped cross-section, is carried fast on the inclined top of a first bracket (B1) erected from the table (T), wherein the inclined top of bracket (B1) is inclined downwardly towards the sewing machine (M). On the other hand, the second guide support member (16) is carried fast on an auxiliary support member (B2*a*) of a second bracket (B2) erected taller than the first one (B1) from the table (T). The auxiliary support member (B2*a*) is inclined on the inclined top of second bracket (B2) at the same angle of inclination with that of the inclined top of the first bracket (B1), so that an inclined coplanar support area is established between the first and second brackets (B1)(B2) to thereby carry the first and second guide support members (15)(16) evenly at a certain degree of inclination angle. Thus, the two guide support members (15)(16) provide an evenly inclined slide passage along which the carriage plate (14) is stably slid and guided along the longitudinal direction of those two particular guide support members (15)(16). Of course, although not clearly shown, but as can be seen from the sectional view of FIG. 6, the first and second brackets (B1)(B2) are both of an inverted-U-shaped form having two vertical leg sections fixed on the table (T) and one inclined horizontal section between the two vertical leg sections, the inclined horizontal section forming the afore-said inclined top upon which the corresponding one of the two guide plate members (B1)(B2) is fixed.

The first guide support member (15) is formed integrally with a downwardly extending guide chute (13) having a channel cross-section, which extends at a right angle from the upstanding lateral wall of first guide support member (15) in a direction towards a sewing area (M1, M2) of sewing machine (M), as can be seen in FIGS. 4 and 6. Designation (15A) denotes an opened outlet area defined between such guide chute (13) and first guide support member (15). Both outlet area (15A) and guide chute (13) are of a width greater than that of each anchor member (B). Hence, as will be explained, one anchor member (B) may be slid by operation of a thruster cylinder (11) from the carriage plate (14) down to the guide chute (13), passing through the opened outlet area (15A), in order to feed the anchor member (B) via the guide chute (13) towards the sewing needle (M1) of sewing machine (M).

Though not shown, the first and second guide support members (15)(16) are connected, at their backward ends (15*e*B)(16*e*B), to a conveyer belt line along which a predetermined set of plural anchor members (B) are supplied onto the carriage plate (14).

Figure 9:
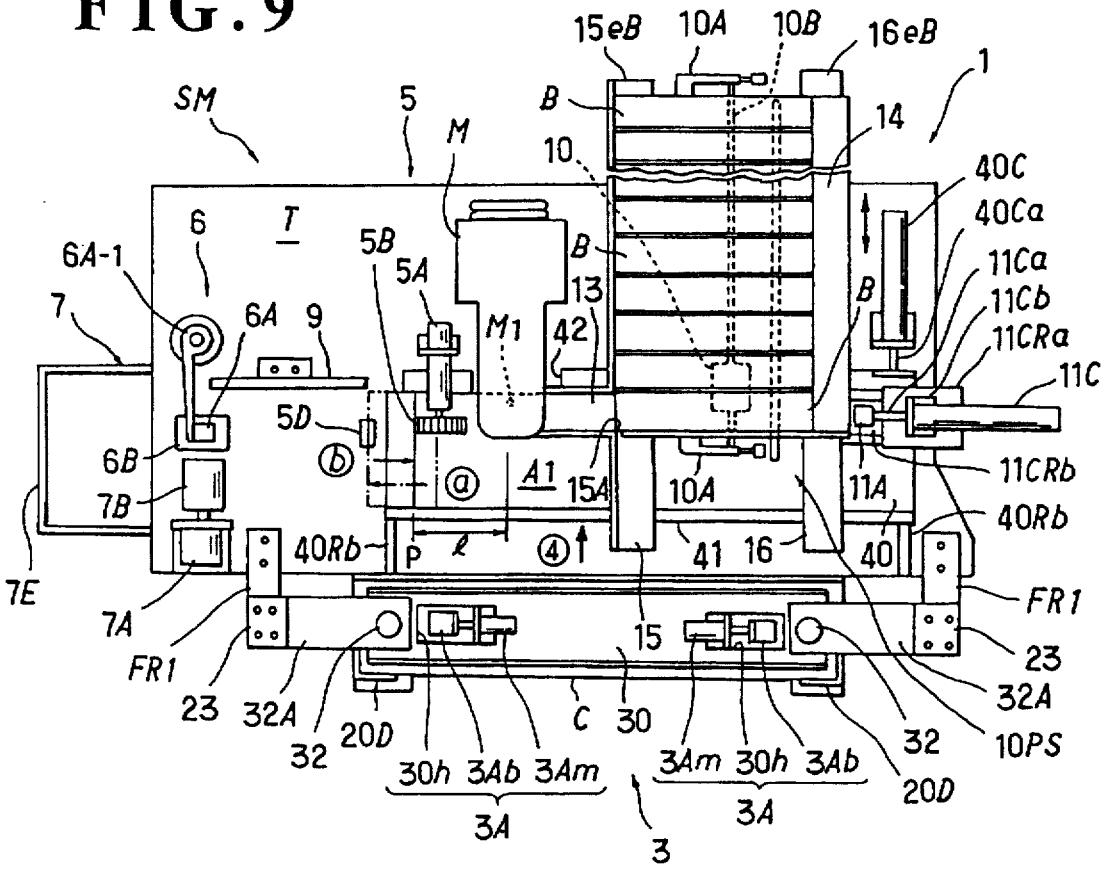
FIG. 9 is a schematic plan view of the sewing system, which explanatorily shows transferring of the covering material to a sewing position and adjustable locating of the same by a locating/setting mechanism to a sewing start point.

The carriage plate (14) has an upturned end part (14*e*B) formed at the forward end thereof to prevent the plural anchor members (B) from falling therefrom when they are supplied from the conveyer belt line. Referring to FIGS. 6 and 9, a pair of connecting arms (10A)(10A) are each fixed to the upturned end part (14*e*B) and backward end part (14*e*A) of the carriage plate (14), respectively. An elongated rack gear member (10B) is connected between those two arms (10A)(10A), such as to extend in parallel therewith, as indicated by the phantom line in FIG. 9. Designation (10) denotes a motor whose output shaft is provided with a pinion gear meshed with a part of the rack gear member (10B), though not shown clearly, but as understandable from FIG. 6, so that normal and reverse operation of the motor (10) causes forward and backward translation of the rack gear member (10B) in the longitudinal direction thereof, which in turn causes the carriage plate (14) to slidingly move on and along the two guide plate members (15)(16). As best shown in FIG. 9, the two connecting arms (10) are provided with a position detector (10PS) which detects a stop position where the carriage plate (14) has to be stopped at a point where a first leading one of the plural anchor members (B) on the carriage plate (14) is just in alignment with both opened outlet area (15A) and guide chute (13) associated with the first support member (15), so that the first leading one of anchor members (B) is ready to be thrust precisely onto the guide chute (13). The position detector (10PS) may be a proximity switch device, as roughly shown in FIGS. 4 and 9 by way of example, which comprises an array of plural position pieces extending alongside of the second support members (16) and two sensors fixed on the respective two connecting arms (10). The two sensors detect one of the plural position pieces to determine the foregoing stop position, or to determine foremost position and rearmost position which limit the forward and backward movements of carriage plate (14), respectively. In this regard, electrically stated, a signal is outputted from the sensors to a CPU in a computer, and the CPU gives an instruction to cease operation of the motor (10) to place the carriage plate (14) at a selected one of those stop, foremost and rearmost positions. Since the position detector (10PS) may be any of other known suitable detectors, this brief explanation suffices in understanding the control of carriage plate (14) for the sake of simplicity.

Figure 10:
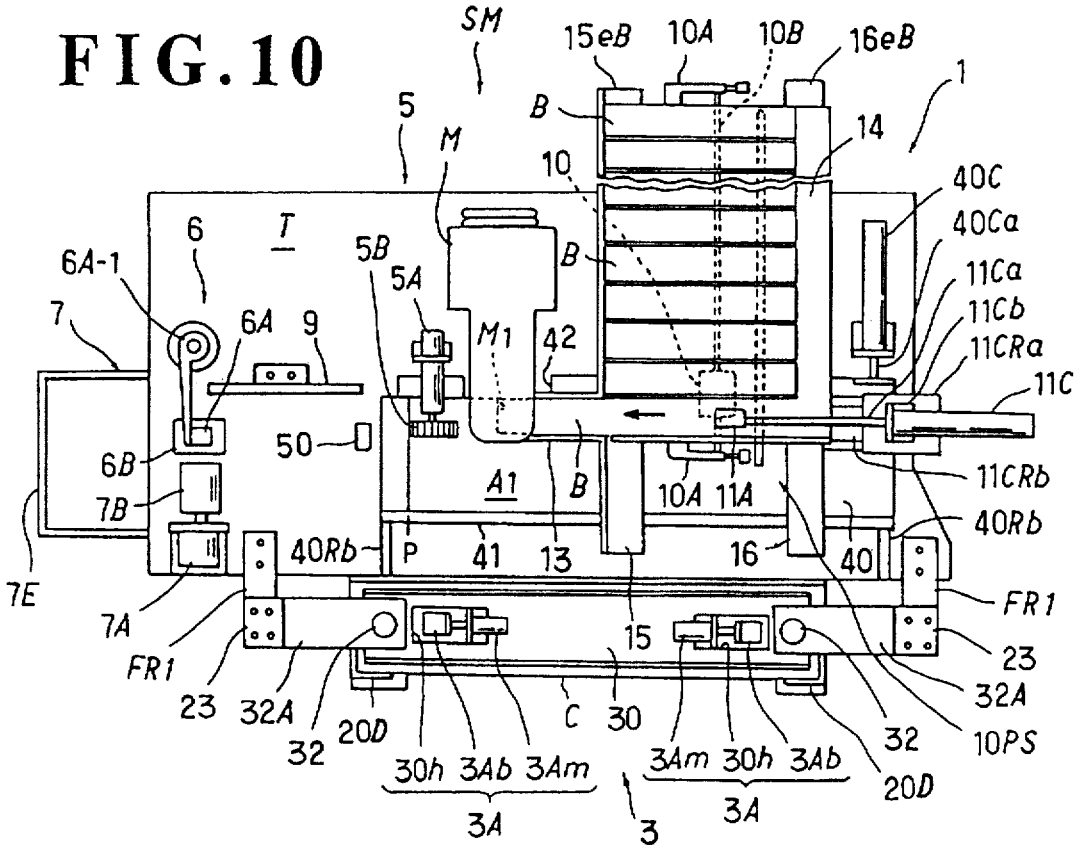
FIG. 10 is a schematic plan view of the sewing system, which shows the anchor member to be thrust by a thruster cylinder to the sewing start point.

The covering material supply mechanism (1) further includes a means for thrusting the anchor member (B) thus located at the foregoing stop position, towards the guide chute (13) and the sewing area (M1, M2) of sewing machine (M). Such means is embodied in the drawings as a thruster cylinder (11C) and its associated elements (11A, 11C*b*, 11CR*a*, 11CR*b*, 11CS, 17, . . . ). The thruster cylinder (11C) has a cylinder rod (11C*a*) and a generally L-shaped contact piece (11A) provided at a free forward end of the cylinder rod (11C*a*), the contact piece (11A) being so formed as to fit contact the rearward end of the anchor member (B) when the cylinder (11C) is operated to extend its cylinder rod (11C*a*) towards the anchor member (B). As viewed from FIGS. 6 and 9, the thruster cylinder (11C) is connected to the second bracket (B2) via a slide rail (11CR*a* and 11CR*b*) and a support plate (11CS) in such a manner as to be inclined downwardly towards the carriage plate (14). Specifically stated, the support plate (11CS) is shown in FIG. 6 as being fixed at one end thereof to the reverse side of horizontal portion of second bracket (B2), to thereby carry both thruster cylinder (11C) and adjustment cylinder (17) at another end portion thereof. Mounted also on that another end portion of support plate (11CS) is a slide rail comprising a stationary lower rail (11CR*b*) and a movable upper rail (11CR*a*) slidably fitted over the stationary lower rail (11CR*b*). The support plate (11CS) is, needless to state, of the same inclination angle with that of the carriage plate (14), thus extending in parallel with the latter. This in turn includes both upper and lower rails (11CR*a*)(11CR*b*) on the same inclination angle. Hence, the thruster cylinder (11C), by the reason that it is fixed on that inclined movable upper rail (11CR*a*) via a bracket (11C*b*), lies generally on the same inclined plane with the carriage plate (14), such as to permit the associated contact piece (11A) to move slightly above the carriage plate (14) for fit contact with the rearward end of anchor member (B) as can be seen in FIG. 10, when in operation.

The movable upper rail (11CR*a*) is connected via a connecting member (17A) to the cylinder rod of adjustment cylinder (17) which is supported via a bracket (17L) on the reverse side of support plate (11CS). With this arrangement, operation of the adjustment cylinder (17) will extend and withdraw its cylinder rod to cause fore-and-aft sliding motion of the upper rail (11CR*a*) along the longitudinal direction of stationary lower rail (11CR*b*), whereby the thruster cylinder (11C) can be adjusted in position relative to the the carriage plate (14) in order to set the contact piece (11A) thereof at a proper position according to a length of the anchor member (B). In the illustrated embodiment, the thruster cylinder (11C) is positioned by the adjustment cylinder (17) at such a location as observed in FIGS. 6 and 9, so that, in operating the thruster cylinder (11C), one stroke (a range of extension) of its cylinder rod (11C*a*) thrusts one anchor member (B) of the shown length to the degree at which one end of the anchor member (B) facing towards the guide chute (13) reaches a sewing position between the sewing needle (M1) and toothed feeder (M2) as shown in FIG. 10. But, for instance, if an anchor member placed on the carriage plate (4) is longer than the illustrated one (B), the adjustment cylinder (17) is automatically or manually operated to move the thruster cylinder (11C) backwards away from the carriage plate (14) via the slide rail (11CR*a*, 11CR*b*) at a proper distance according to the increased length of anchor member, so that, in operation, one stroke of the cylinder rod (11C*a*) thrusts that long anchor member to such a degree where one end of the same anchor member facing towards the guide chute (13) reaches the sewing position between the sewing needle (M1) and toothed feeder (M2), as in FIG. 10. Conversely, if an anchor member of a small length is used relative to the illustrated one (B), the thruster cylinder (11C) is displaced towards the carriage plate (14) by operation of the adjustment cylinder (17) at a proper distance according to the decreased length of such short anchor member, thereby allowing one stroke of the cylinder rod (11C*a*) of operated thruster cylinder (11C) to positively bring one end of the short anchor member facing towards the guide chute (13), to the aforementioned sewing position. For that purpose, the adjustment cylinder (17) may be controlled by a computer or a manual switch for adjustment of the thruster cylinder (11C) in a proper position, depending on the length of anchor member (B).

The covering material storage device (2) is shown in FIG. 4 to be situated laterally of and below the table (T), comprising a container receiving member (20) and a pair of springs (21)(21) for resiliently supporting the container receiving member (20) at a fixed level. The container receiving member (20) is formed by a horizontal base section (20A) and a vertical section (20C) to provide a space for accommodating a container (C) in which a plurality of covering materials (A1) are stacked with one another vertically. The container receiving member (20) is further formed with a pair of lateral connecting wall sections (20B)(20B) to which the foregoing pair of springs (21)(21) are fixedly connected, respectively. Still further, a pair of upwardly projected L-shaped corner holders (20D)(20D) are provided fast on the two forward corner portions of the container receiving member (20), respectively, as seen from FIG. 4. This construction of container receiving member (20) accommodates different sizes of containers (e.g. (C)) therein. That is, the covering material (A1) used may vary in length, in which case, different sizes of containers must be used for containing the different lengths of covering materials (e.g. (A1)), and therefore, the container receiving member (20) itself is greater in depth than all different containers (e.g. (C)) of different sizes to be used in this system (SM). Likewise, the two L-shaped corner holders (20D)(20D) are both of a sufficient size to contact the two lower corner portions of all different containers (e.g. (C)) to be used, as understandable from FIGS. 5 and 7 for example, to thereby prevent the container (C) from being fallen from the container receiving member (20).

As shown in FIG. 5, a pair of slide holders (20B*c*)(20B*c*) are fixed to the two lateral connecting wall sections (20B) (20B), respectively. Each slide holder (20B*c*) has a hole through which a guide rod (22) slidably passes, such that the slide holder (20B*c*) may be slidingly moved along the guide rod (22) in the vertical direction. The guide rod (22) is supported fast on the horizontal lower end part (23E) of a bracket (23). As shown, a pair of such brackets (23)(23) are each fixed at its upper end to the two connecting frames (FR1)(FR1), respectively. The two connecting frames (FR1) (FR1) are fixed at their one ends to the table (T) and fixed at their another ends to the respective tops of two forward leg frame sections (FR2)(FR2) of base frame (FR), as seen in FIG. 4. Thus, a pair of the guide rods (22) are each supported on the respective horizontal lower end parts (23E)(23E) of two brackets (23)(23), with a pair of coil springs (21)(21) being mounted around the respective two guide rods (22)(22). An upper end of each coil spring (21) is connected to each slide holder (20BC), as shown in FIG. 5, whereupon the container receiving member (20) is interposed between and resiliently supported by the two coil springs (21)(21) in such a manner as to be movable along the vertical axes of the springs (21). It is noted here that the springs (21) should have an upwardly biasing force tending to raise the container (C) at such proper level that the uppermost one of the covering materials (A1) loaded in the container (C) is always positioned at a fixed level (h2) as can be seen in FIG. 5. Otherwise stated, the biasing force of the springs (21) is so adjusted as to tend to raise the container (C) progressively each time one covering material (A1) is removed from the container (C), to thereby insure that an uppermost one of the plural stacked covering materials (A1) is raised to and retained at that fixed level (h2).

In the present sewing system (SM), the vertical and horizontal transfer mechanisms (3)(4) are provided to catch and transfer the aforementioned uppermost one of covering materials (A1) stored in the container (C) in a direction towards the sewing machine (M) on the table (T).

Figure 7:
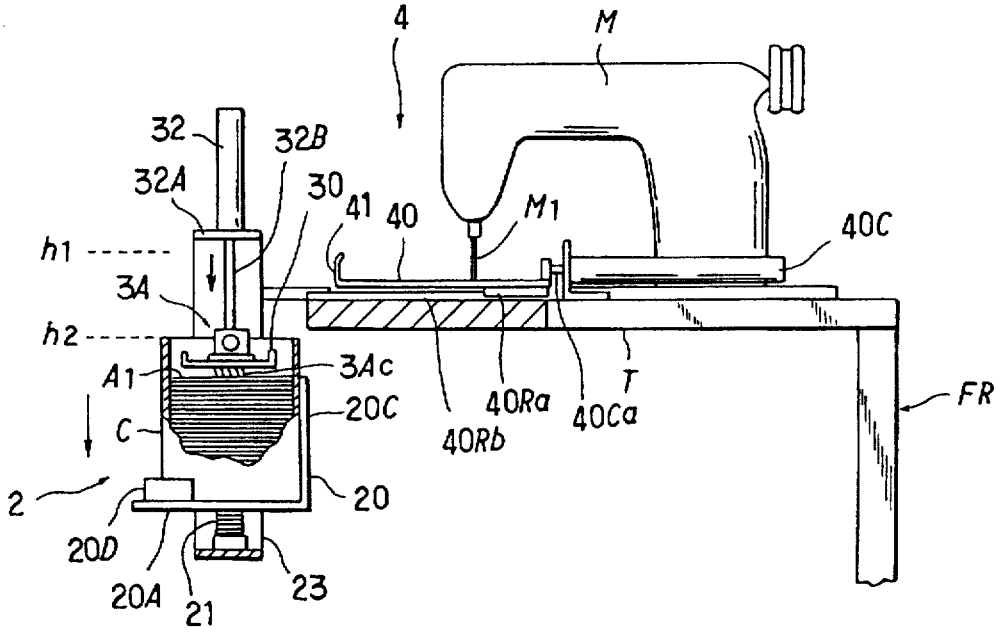
FIG. 7 is a partly broken fragmentary side view of the sewing system, which explanatorily shows the action of the vertical transfer mechanism to catch an uppermost one of the covering materials.
Figure 8:
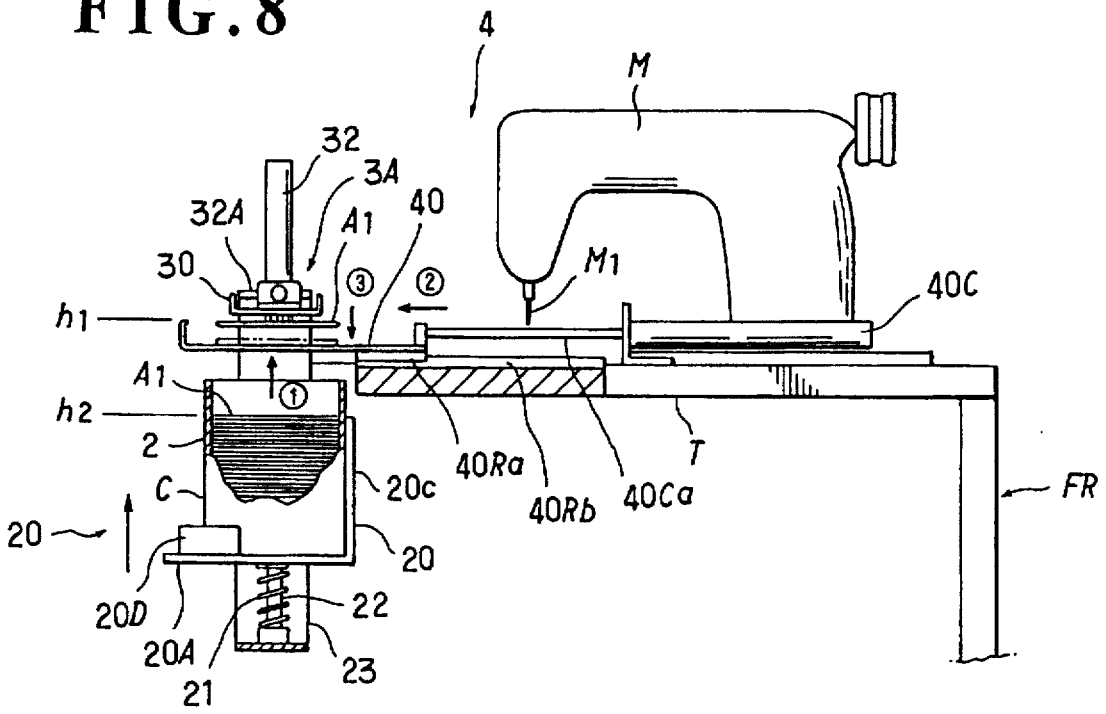
FIG. 8 is a partly broken fragmentary side view of the sewing system, which explanatorily shows the actions of the vertical and horizontal transfer mechanism.

The vertical transfer mechanism (3) is shown to be disposed above the container receiving member (2) in a parallel relation with the horizontal base section (20A) of that container receiving member (2). This mechanism (3) is essentially composed of: a pair of spaced-apart support brackets (32A)(32A); a horizontal catcher plate (30) connected via two elevation cylinders (32)(32) to the respective two support brackets (32A)(32A); and a pair of spaced-apart catching devices (3A)(3A) for directly catching the uppermost one of covering materials (A1). The two support brackets (32A)(32A) are each fixed to the respective top portions of two forward leg frame sections (FR2)(FR2) associated with the base framework (FR). The respective free end portions of support brackets (32A)(32A) extend towards each other in a mutually spaced-apart relation, and the two elevation cylinders (32)(32) are each fixed on those respective free end portions of support brackets (32A)(32A). The catcher plate (30) is coupled, at both lateral end portions thereof, to the two cylinder rods (32B)(32B) respectively of the two elevation cylinders (32)(32) in such a manner as to extend horizontally between the two forward leg frame sections (FR2)(FR2) in a parallel relation with the base portion (20A) of container receiving member (20). Operating the elevation cylinders (32) will cause vertical displacement of the catcher plate (30) towards and away from that container receiving member base portion (20A). It is noted that the catcher plate (30) per se is small relative to the cubic dimension of container (C) or of other different sizes of containers to be used, so that the catcher plate (30) can be freely entered into the container for access to the uppermost one of covering materials (A1) loaded therein, as seen in FIGS. 7 and 8. Further, the catcher plate (30) has a pair of spaced-apart holes (30*h*)(30*h*) perforated therein, which form one part of the catching device (3A).

Disposed respectively at those two holes (30*h*)(30*h*) of catcher plate (30) are the previously stated two catching devices (3A)(3A). Each catching device (3A) comprises: such hole (30*h*); a cylinder (3A*m*) fixed on the catcher plate (30) in the vicinity of the hole (30*h*); a movable bracket (3A*b*) connected to the cylinder rod of the cylinder (3A*m*); and one set of plural catching needles (3A*c*) provided at the movable bracket (3A*b*). As illustrated, the two cylinders (3A*m*)(3A*m*) of this catching device (3A) are disposed adjacent and between the spaced-apart two holes (30*h*)(30*h*) upon the plate (30), such that the respective cylinder rods of two cylinders (3A*m*)(3A*m*) extend in a direction opposite to each other. The movable bracket (3A*b*) is connected to each of the respective cylinder rods of two cylinders (3A*m*)(3A*m*) and can be moved within the hole (30*h*) in the longitudinal direction of catcher plate (30) by operation of the cylinder (3A*m*), whereby two sets of the plural catching needles (3A*c*)(3A*c*) may be displaced by operation of the two cylinders (3A*m*)(3A*m*) towards and away from each other, for the purpose of releasing and forcing a hitched engagement of the needles (3A*c*) with the gigged upper surface (a) of covering material (A1), as will be explained later.

The thus-constructed vertical transfer mechanism (3) is first operated when a start switch (not shown) is turned on, so as to actuate the two elevation cylinders (32)(32) to lower the catcher plate (30) from an inoperative position (at h1) down into within the container (C) as shown in FIG. 7. As understandable from FIGS. 5 and 7, it is important that the stroke or vertical movement range of both cylinder rods (32B) of elevation cylinders (32) should be set from an upper limit indicated by (h1) to a lower limit below the previously mentioned level (h2) at which an uppermost one of the covering materials (A1) is normally retained. This is because, (i) a certain spacing must be given between the container (C) and inoperative catcher plate (30) to allow a transfer plate (40) to move therebetween, as in FIG. 5, and (ii) the catcher plate (30) should be lowered far into within the container (C) (i.e. below the level (h2)) against the biasing force of springs (21), as shown in FIG. 7, to thereby produce an amplified pressure between the catching needles (3A*c*) and the gigged surface (a) of covering material (A1) so as to deeply entangle the needles (3A*c*) with the gigged or raised fiber portion of covering material (A1). As can be seen in FIG. 5, the two sets of catching needles (3A*c*)(3A*c*) are slanted outwardly away from each other with a view to insuring their hitched engagement with the gigged surface (a) of covering material (A1).

The horizontal transfer mechanism (4) comprises a transfer plate (40) which is provided on the table (T) for horizontal sliding movement thereon, and a cylinder (40C) fixed on the on the table (T) as shown, the cylinder (40C) being connected, at its cylinder rod (40C*a*), to the backward end part of the transfer plate (40). The transfer plate (40) has an upturned edge portion (41) formed at the forward end thereof, facing towards the side of table (T) where the covering material storage device (2) is located. As can be seen in FIG. 7 in conjunction with FIG. 9, the transfer plate (40) has a pair of upper rails (40R*a*)(40R*a*) fixed on the reverse side thereof, which are slidably fitted on a pair of lower rails (40R*b*)(40R*b*) fixed on the table (T), respectively. As the pair of lower rails (40R*b*)(40R*b*) extend generally from the center of the table (T) to the lateral end of the same (T) where the covering material storage device (2) and vertical transfer mechanism (3) are located, the transfer plate (40) may be translated in a direction transversely of the table (T) between the sewing machine (M) and covering material storage device (2) by operation of the cylinder (40C), for the purpose of receiving the covering material (A1) and transferring it to a sewing position on the table (T), as will be explained in detail later. The transfer plate (40) is formed, at its backward end, with one cut-away region (42) to avoid interference with the sewing needle (M1) and toothed feeder (M2) of sewing machine (M) and another cut-away region (43) to avoid contact with the foregoing three brackets (B1)(B2)(B3) erected on the table (T) when the transfer plate (40) is moved towards the sewing machine (M). Further, the transfer plate (40) is formed with a hole (44) therein at one lateral side thereof facing towards the detector (6) and discharging mechanism (7), as shown in FIG. 4. This hole (44) is so disposed on the transfer plate (40) that, when the plate (40) is set at such home position as in FIG. 4, the hole (44) is positioned between the upper drive and lower auxiliary rollers (5B)(5C) associated with the locating mechanism (5), as best shown in FIG. 6, so that the lower auxiliary roller (5C) can be raised through the hole (44) for contact with the upper drive roller (5B), as will be described later.

The locating/setting mechanism, as generally designated by (5), is designed to detect the length of covering material (A1), then adjustably locate the covering material (A1) relative to the sewing machine (M) according to the detected length of the same (A1), and set a sewing start point from which the covering material (A1) has to be sewn with the anchor member (B). This mechanism (5) comprises: a motor (5A) fixed on the table (T) in the neighborhood of the sewing machine (M); an upper drive roller (5B) connected to an output shaft of the motor (5A); a lower auxiliary roller (5C) disposed right below the upper drive roller (5B), the lower auxiliary roller (5C) being connected to an elevation cylinder (51) for vertical movement through a hole (Tb) of the table (T) in a direction towards and away from the upper drive roller (5B); and a sensor (50) for detecting the covering material (A1). As shown in FIG. 6, the upper drive roller (5B) is situated above the table (T) a distance greater than a total height-wise thickness of both transfer plate (40) and covering material (A1), so that, in operation, the covering material (A1) may be smoothly slid on the transfer plate (40), without interference from the upper drive roller (5B), for sewing with the anchor member (B). On the other hand, the lower auxiliary roller (5C) is normally positioned within the hole (Ta) of table (T) by the elevation cylinder (51) fixed via a bracket to the reverse side of table (T), which avoids interference with the movement of transfer plate (40). The sensor (50) is fixed via a bracket to the table (T) such as to be disposed in a hole (Tb) of table (T) without projecting from the upper surface of table (T). As shown in FIG. 9, the sensor (50) is situated adjacent to one lateral side of the transfer plate (40) and on the same line with the upper drive roller (5B). The distance between the sensor (50) and the central axis of upper drive roller (5B) is preset and stored in memory of computer. Briefly stated, as viewed from FIG. 9, when one covering material (A1) is brought to a sewing position by the transfer plate (40), the left-side end portion of that covering member (A1) is grasped between the upper drive and lower auxiliary rollers (5B)(5C) due to the raising of the lower auxiliary roller (5C) towards the upper drive roller (5B) by operation of the associated cylinder (51). Then, the upper drive roller (5B) is rotated in normal direction by operation of the motor (5A) to feed the covering material (A1) towards the sensor (50), and as the sensor (50) detects the left-side end portion of covering material (A1), a signal is outputted therefrom to a CPU (not shown) which determines the length of covering material (A1) by counting the rotation of motor (5A) against the above-stated distance between the sensor (50) and central axis of upper drive roller (5B), and gives an instruction to operate the motor (5A) in reverse direction so as to cause reverse rotation of the upper drive roller (5B). The covering material (A1) is thereby fed backwards to an appropriate setting position (P) according to the length of covering material (A1) under control of the CPU. At the setting position (P), the left-side end of covering material (A1) is finally located at a proper distance (l) relative to the sewing needle (M1) of sewing machine (M), thereby establishing a sewing start point from which the covering material (A1) and anchor member (B) start to be sewn together by the sewing machine (M). This arrangement permits for automatically locating and setting each of different covering materials of different lengths at a proper sewing start point for sewing with the anchor member (B), depending on the whole length of the covering material.

The stop detector (6) is arranged at one lateral end portion of the table (T) apart from the foregoing locating/setting mechanism (5). The stop detector (6) is a reflection-type photosensitive detector comprising a light emitting sensor (6A) and a light reflection plate (6B). As shown, the light emitting sensor (6A) is supported on the vertically extending support rod (6A-1) such as to be disposed above the reflection plate (6B) fixed in the upper surface of table (T). A light beam is normally applied from the sensor (6A) down to the reflection plate (6B) and reflected therefrom to the sensor (6A). Both light emitting sensor (6A) and reflection plate (6B) are so designed and dimensioned as to determine a proper stop point for stopping the covering material (A1) fed from the sewing machine (M), according to the length of covering material (A1). In this regard, a computer's CPU (not shown) has already stored in memory a data on the length of covering material (A1) from the locating/setting mechanism (5), and adjusted the detecting range of sensor (6A) for detecting one end of covering material (A1) on the basis of such data. The detecting range is a range of light emission from the sensor (6A) to the light reflection plate (6B). For example, in the case where a covering material of a relatively small length is recognized at the locating/setting mechanism (5), the CPU will adjust the sensor (6A) so as to widen its light emission range to the reflection plate (6B), so that the sensor (6A) may detect one end of such short covering material fed from the sewing machine (M). Then, the CPU will immediately give an instruction to stop the operation of sewing machine (M) at a sewing end point where the anchor member (B) is completely sewn with the covering material along the whole length thereof, as can be seen from FIG. 11. Conversely, in the case where a covering material of a relatively great length is recognized at the locating/setting mechanism (5), then the CPU will adjust the sensor (6A) so as to reduce its light emission range to the reflection plate (6B), so that the sensor (6A) may detect one end of such relatively long covering material fed from the sewing machine (M). Then, likewise as in the foregoing case, a stop instruction will be sent from the CPU, immediately, to cease operation of sewing machine (M) at the sewing end point where the whole length of anchor member (B) is completely sewn with the covering material, as can be seen from FIG. 11. Those specific operations are however one example and not limitative. Also, the associated peripheral electronic elements are not shown in the drawings, but may be materialized by any suitable known computerized control elements and arrangements.

Designation (9) denotes a rectilinearly extending guide member interposed between the stop detector (6) and the locating/setting mechanism (5). This guide member (9) extends alongside of a path in which the covering material (A1) is fed from the sewing machine (M), to thereby guide the covering material (A1) towards the stop detector (6).

The discharging mechanism (7) is operable to discharge a resultant sewn unit of the anchor member (B) and covering material (A1) (see FIG. 2) out of the table (T) into a container (7E). Referring now to FIGS. 6 and 9, this discharging mechanism (7) is comprised of: a motor (7A) mounted on the table (T); an upper drive roller (7B) fixed to an output shaft of the motor (7A); a lower auxiliary roller (7C); an elevation cylinder (71) for raising and lowering the lower auxiliary roller (7C) in a direction towards and away from the upper drive roller (7B); and a container (7E) provided at one terminal end of the table (T). Both motor (7A) and upper drive roller (7B) are disposed on the table (T) adjacent to the above-stated stop detector (6). The motor (7A) is situated outside the path along which the covering material (A1) is fed from the sewing machine (M), while the upper drive roller (7B) projects in a direction transversely of such path. As can be seen in FIG. 6, the upper drive roller (7B) is further disposed above the table (T) a distance greater than the thickness of covering material (A1), thus allowing movement of the covering material (A1) between the roller (7B) and table (T). On the other hand, the lower auxiliary roller (7C) is connected to the cylinder rod of elevation cylinder (71) fixed via a bracket to the reverse side of table (T). Normally, this particular roller (7C) is positioned within the hole (Tc) of table (T) and not projected from the upper surface of table (T). Operation of the cylinder (71) will raise the roller (7C) from the hole (Tc) towards the upper drive roller (7B). With this arrangement, the covering material (A1) is grasped by the upper drive and lower auxiliary rollers (7B)(7C), and then, operation of the motor (7A) rotates the upper drive roller (7B) to feed and discharge the covering material (A1) into the container (7E).

Now, a description will be made of detailed operations of the above-constructed sewing system (SM).

Firstly, upon a start switch (not shown) turned on, the two elevation cylinders (32)(32) of vertical transfer mechanism (3) are actuated to lower the catcher plate (30) from the home position (h1) down into within the container (C) placed on the container receiving member (20), as shown in FIG. 7. The catcher plate (30) continues to be lowered to forcibly press two sets of plural catching needles (3A*c*) (3A*c*) against the stacked covering materials (A1), to the degree at which both container (C) and container receiving member (20) are also lowered to forcibly contract the two coil springs (21)(21), thereby receiving a counter biasing force therefrom. In this way, the catching needles (3A*c*) are strongly driven into the gigged surface (a) of covering material (A1) for entanglement with the raised fiber portions of covering material (A1). Thereafter, the two cylinders (3A*m*)(3A*m*) of catching device (3A) are actuated to extend their respective cylinder rods to move those two sets of catching needles (3A*c*)(3A*c*) outwardly away from each other to thereby make positive the entanglement between the needles (3A*c*) and raised fiber portions of covering material (A1), whereby the covering material (A1) per se is securely retained by the catcher plate (30) against removal therefrom at this point. Then, both two elevation cylinders (32)(32) of vertical transfer mechanism (3) are actuated reversely to raise the catcher plate (30), as indicated by the arrow (①) in FIG. 8, thereby transferring the covering material (A1) upwardly to a point generally on the same level with the home position (h1) of catcher plate (30). When the catcher plate (30) reaches that home position (h1), the cylinder (40C) of horizontal transfer mechanism (1) is operated to slidingly move the transfer plate (40) on the table (T) in the direction of arrow (②) in FIG. 8 towards the catcher plate (30), and stop the same (40) at a point below the covering material (A1) retained by the catcher plate (30). Then, the two cylinders (3A*m*)(3A*m*) of catching device (3A) are actuated to move the two sets of plural catching needles (3A*c*)(3A*c*) towards each other to release the hitched engagement between the needles (3A*c*) and covering material (A1), so that the covering material (A1) is fallen from the catcher plate (30) and loaded on the transfer plate (40) as indicated by the arrow (③) and two-dot chain line in FIG. 8.

Next, the cylinder (40C) of horizontal transfer mechanism (4) is operated in reverse so as to draw the transfer plate (40) back to a home position upon the table (T), as indicated by the arrow (④) in FIG. 9, whereupon the covering material (A1) is roughly transferred to and located at a sewing position under the sewing machine (M) and anchor member supply mechanism (1). Such roughly located covering material (A1) is then subjected to detection of its length and then locating at a sewing start position by the locating/setting mechanism (5). Namely, referring again to FIG. 9, assumed that the covering material (A1) is of such length that its one left-side end is situated at a two-dot line (ⓐ) between the transfer plate (40) of horizontal transfer mechanism (4) and the upper drive roller (5B) of locating/setting mechanism (5), then the lower auxiliary roller (5C) (see FIG. 6) of the present locating/setting mechanism (5) is raised by operation of the associated elevation cylinder (51), projecting through the two holes (Ta)(44) respectively of the table (T) and transfer plate (40) to press the left-side one end of covering material (A1) against the upper drive roller (5B). Thus, the covering material (A1) is sandwiched and retained between the upper drive and lower auxiliary rollers (5B)(5C). The motor (5A) is then operated to rotate the upper drive roller (5B) in normal direction so as to feed the covering material (A1) towards the sensor (50) as indicated by the one-dot chain line and arrow in FIG. 9. Upon the left-side end of covering material (A1) being detected by the sensor (50), a CPU (not shown) determines a length of that covering material (A1) and immediately sends an instruction to cause reverse operation of the motor (5) so as to displace the covering material (A1) from the sensor (50) towards the solid line which is a proper setting point (P) for the length of covering material (A1). Therefore, a sewing start point is set in the covering material (A1) at a distance (l) from the thus-determined setting point (P). At such sewing start point, the sewing needle (M1) is disposed, so that operation of the sewing machine (M) will cause the anchor member (B) to be sewn with the covering material (A1) from the sewing start point.

After this locating operations, as shown in FIG. 10, the thruster cylinder (11C) is actuated to extend its cylinder rod (11C*a*) and contact piece (11A) towards a first leading one of the plural anchor members (B) placed on the carriage plate (14). The contact piece (11A) contacts the backward end of that first anchor member (B), and then, the anchor member (B) is thrust by the thruster cylinder (11C) into the guide chute (13). The thruster cylinder (11C) continues its operation to thrust the anchor member (B) along the guide chute (13) until the forward end of anchor member (B) reaches a point right under the sewing machine (M). Of course, when the forward end of anchor member (B) reaches such point, the thruster cylinder (11C) is automatically stopped and actuated reversely to withdraw its contact piece (11A) to the home position as shown in FIG. 9.

Next, as the forward end of anchor member (B) lies on the covering material (A1) at the sewing start point as shown in FIG. 10, the sewing machine (M1) starts to operate for sewing together the anchor member (B) and covering material (A1) from the foregoing sewing start point. As understandable from FIG. 11, both longitudinal lateral end portions of the anchor member (B) and covering material (A1) are sewn together by the sewing machine (M), leaving a seam (B1) therealong. During the sewing, both anchor member (B) and covering material (A1) are automatically fed by the toothed feeder (M2) of sewing machine (M) and guided by the guide member (9) in the direction towards the stop detector (6).

Figure 11:
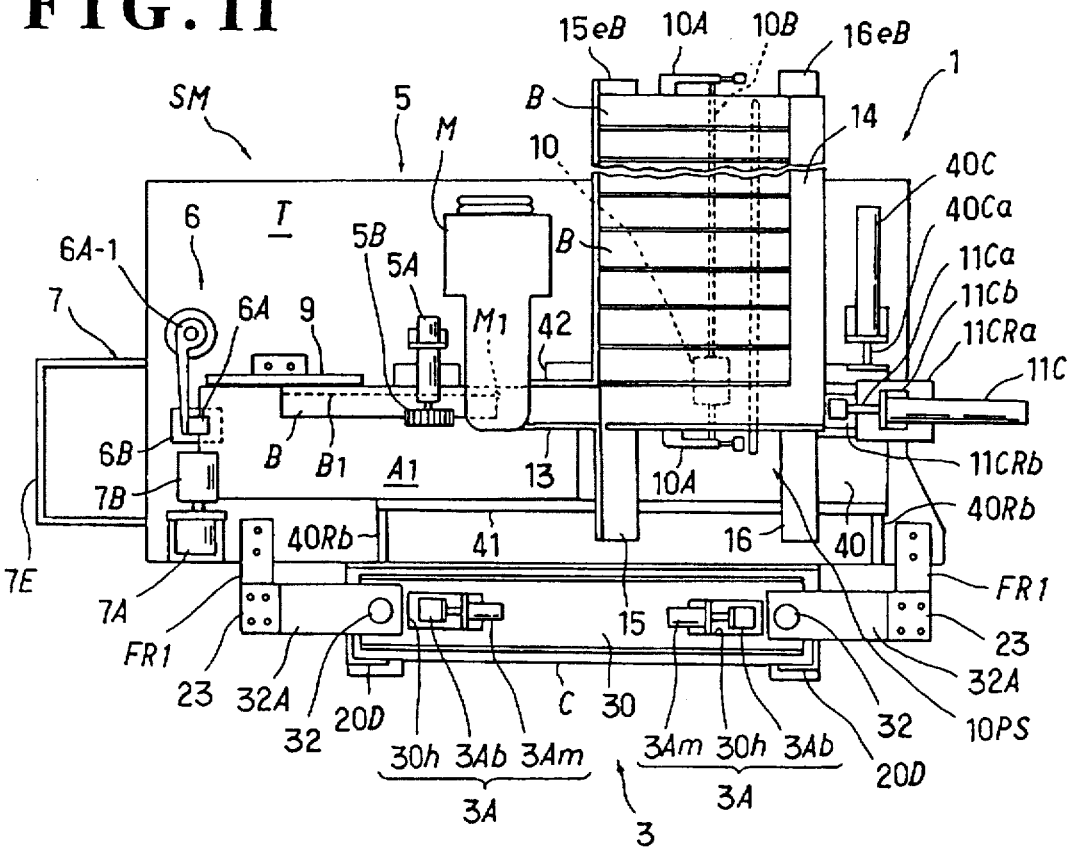
FIG. 11 is a schematic plan view of the sewing system, which shows the anchor member to be completely sewn with the covering material, and also shows the state where a resulting sewing product of those anchor member and covering material is about to be discharged by a discharging mechanism out of the sewing system.

As viewed from FIG. 11, when a left-side end of the covering material (A1) being sewn with the anchor member (B) reaches a point between the light emitting sensor (6A) and reflection plate (6B) of the stop detector (6), the light emitting sensor (6A) recognizes it by detecting a light interception amount at which the covering material (A1) intercepts the light beam applied from the sensor (6A) to the reflection plate (6B). As previously described, the sensor (6A) has been adjusted by a CPU as to its light emission ragnge against the rejection plate (5) according to the length of covering material (A1). Hence, in the present embodiment, at the time when the left-side end of covering material (A1) intersects the adjusted rage of light emitted from the sensor (6A), the sewing machine (M) is just deenerzised automatically to stop sewing the anchor member (B) to the covering meaterial at a point corresponding to the backward end of the anchor member (B), as shown in FIG. 11. It is noted here that the left-side end of covering material (A1) lies between the upper drive and lower auxiliary rollers (7B)(7C) of the discharging mechanism (7), though not clearly shown, but as understandable from FIG. 11.

Figure 1:
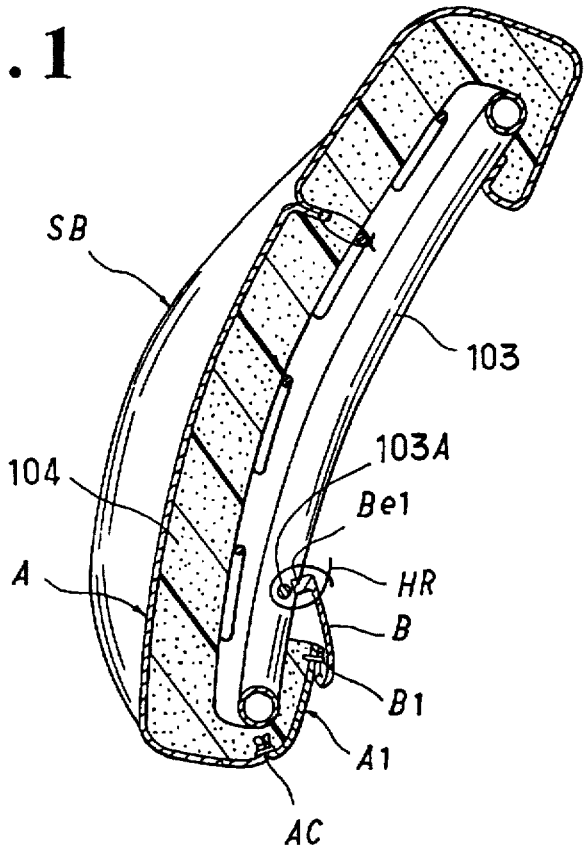
FIG. 1 is a schematic longitudinal sectional view of a seat back of vehicle seat, in which one end of covering material is anchored via an anchor member to a seat back frame.
Figure 2:
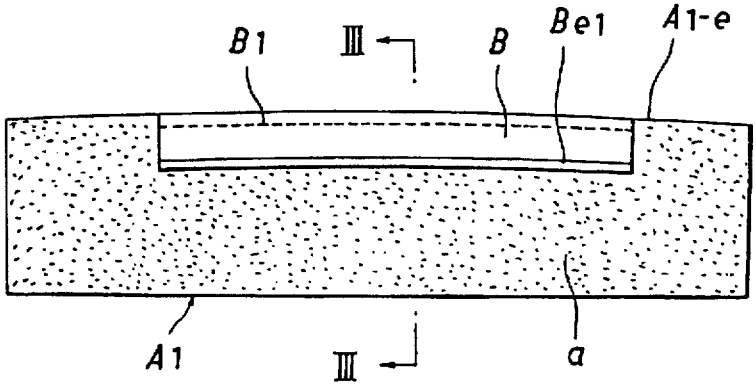
FIG. 2 is a plan view of a sewn product of the anchor member and covering material.
Figure 3:
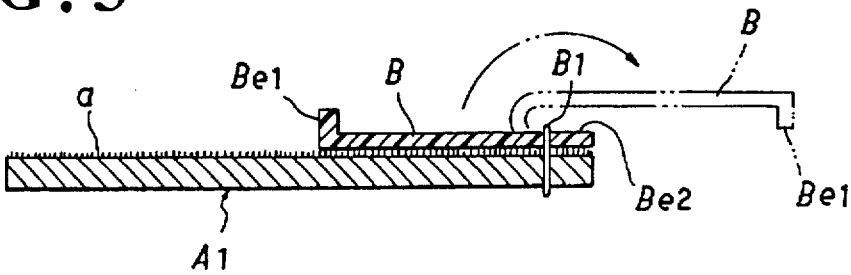
FIG. 3 is a sectional view taken along the line III—III in FIG. 2.

Now, the whole length of anchor member (B) is completely sewn with a predetermined area of the covering material (A1) to provide a resulting sewn product shown in FIG. 2.

At the completion of this sewing operation, the elevation cylinder (71) of the discharging mechanism (7) is acuated to raise and project the lower auxiliary roller (7C) through the hole (Tc) of table (T) towards the upper dive roller (7B), thereby causing the foregoing left-side end part of covering material (A1) to be retained between the two rollers (7B)(7C). Then, the motor (7A) is operated to rotate the upper drive roller (7B) to feed the resulting sewn product for discharge into the container (7).

Subsequently, the same series of operations described above may be repeated automatically under a compterized control to produce a predetermined number of such resulting cover section products as shown in FIG. 2. Basically, in this automated operation, it is so arranged that, after a first anchor member (B) is sewn with a first covering material (A1), the anchor member supply mechanism (1) is not operated to introduce a next second anchor member (B) to the sewing portion (M1, M2) until a next second covering material (A1) is transferred to and located at a sewing start point by the vertical and horizontal transfer mechanisms (3)(4) and transfer mechanisms (3)(4). In this way, the carriage plate (14) is stopped to retain such next second anchor member (B) within the L-shaped cross-section of first guide support member (15) before the carriage plate (14) is advanced towards the forward end (15eF) of first guide support member (15) to set the second anchor member (B) at the opened outlet area (15A).

The present sewing system (SM) may be arranged such that different sizes of the containers (C) can be detected by a proper sensor (e.g. photosensor or weight sensor) so as to determine the length of covering materials (A1) loaded in the container (C), and a signal will be outputted from the sensor to a CPU which will then control the locating/setting mechanism (5) and detector (6) in order to effect locating of the covering material (C) at a proper sewing start point as stated previously.

While having described the present invention thus far, it should be understood that the invention is not limited to the illustrated embodiments, but any other modifications, replacements and additions may structurally be applied thereto without departing from the scopes of the appended claims.

What is claimed is:

1. A system for sewing an anchor member to a covering material for use on a vehicle seat, comprising:

a base means;

a sewing machine provided on said base means, said sewing machine having a sewing needle and a feeder means;

an anchor member supply mechanism provided on said base means, said anchor member supply mechanism including:

a carriage means on which a plurality of anchor members are to be placed abreast with one another, said carriage means being operable to introduce one of said plurality of said anchor members to a feed position oriented toward said sewing needle and feeder means of said sewing machine; and a thruster means for thrusting said one of said plurality of said anchor members, at said feed position, in a direction toward a sewing start point adjacent to said sewing needle and feeder means of said sewing machine;

a covering material storage means for storing a plurality of said covering materials therein in a vertically piled manner, said covering material storage means being provided laterally of and below said base means, and including a biasing means for resiliently biasing said plurality of covering materials in an upward direction, wherein a biasing force of said biasing means is so adjusted as to tend to raise said plurality of said covering materials progressively as one of said plurality of said covering materials is removed from said covering material storage means, such as to insure that an uppermost one of said plurality of covering materials is always positioned at a fixed level;

a vertical transfer mechanism provided at said base means, said vertical transfer mechanism being operable vertically towards and away from said covering material storage means so as to catch said uppermost one of said plurality of covering materials, to thereby secure one covering material from said plurality of said covering materials, and then transfer said one covering material upwardly from said covering material storage means to a level above said base means;

a horizontal transfer mechanism provided at said base means in vicinity of said sewing machine, said horizontal transfer mechanism being operable horizontally between said vertical transfer mechanism and said sewing machine so as to receive said one covering material from said vertical transfer mechanism and then transfer said one covering material to a sewing position where said sewing needle and feeder means of said sewing machine are disposed; and a discharging mechanism provided at one end portion of said base means, said discharging mechanism including a discharging area disposed outside said base means;

wherein, said one covering material is transferred by operation of said vertical and horizontal transfer mechanisms to said sewing position, and then said one of said plurality of said anchor members is thrust by said thruster means to said sewing start point, and wherein operation of said sewing machine causes said one of said plurality of said anchor members to be sewn with said one covering material from said sewing start point to produce a resulting sewn product of a covering material and an anchor member, and operation of said discharging mechanism causes said resulting sewn product of the covering material and the anchor member to be discharged out of said base means to said discharging area.

2. The sewing system according to claim 1, wherein said anchor member is formed from a synthetic resin material.

3. The sewing system according to claim 1, wherein said carriage means of said anchor member supply mechanism comprises: a guide support means mounted fast on said base means; a carriage plate on which said plurality of anchor members are to be placed abreast with one another, said carriage plate being slidably mounted upon said guide support means; and a drive means for causing said carriage plate to slidingly move said carriage plate on said guide support means and stop the same at said feed position, so that, at said feed position, said one of said plurality of anchor members placed on said carriage plate is thrust and fed by said thruster means to said sewing start point.

4. The sewing system according to claim 3, wherein said guide support means has a guide chute of a generally channel cross-shape formed therein in correspondence with said feed position, and wherein said guide chute extends towards a point adjacent to said sewing start point, thereby allowing said one of said plurality of said anchor members to be slid along said guide chute to said sewing start point.

5. The sewing system according to claim 3, wherein said drive means comprises: a motor supported fast on said base means; a rod-like guide means fixed to a reverse side of said carriage plate; said rod-like guide means extending along a longitudinal direction of said carriage plate and in parallel with said guide support means; and a threaded engagement means for threadedly engaging said motor with said like guide means, wherein operation of said motor causes displacement of said rod-like guide means in the longitudinal direction thereof to thereby move said carriage plate on and along said guide support means, and wherein said drive means further includes a position detector means by which said motor is operated and stopped so as to move and stop said carriage plate, such that each of said plurality of said anchor members is set at said feed position.

6. The sewing system according to claim 1, wherein said thruster means of said anchor member supply mechanism comprises a thruster cylinder disposed adjacent to and slightly above said carriage means, said thruster cylinder being operable to extend and withdraw its cylinder rod in a direction toward and away from said feed position in said carriage means, so that operation of said thruster cylinder extends the cylinder rod thereof to thrust and feed said one of said plurality of said anchor members to said sewing start point.

7. The sewing system according to claim 6, wherein said thruster means further comprises an adjustment means for adjusting a position of said thruster cylinder according to a different length of said anchor member, thereby allowing said different length of said anchor member to be precisely thrust and fed by the cylinder rod of said thruster cylinder to said sewing start point.

8. The sewing system according to claim 7, wherein said adjustment means comprises a cylinder and a slide means, and wherein a cylinder rod of said cylinder is connected, via said slide means, to said thruster cylinder.

9. The sewing system according to claim 1, wherein said covering material storage means includes a storage base means on which said plurality of covering materials are to be piled with one another vertically, and wherein said biasing means of said covering material storage means comprises a spring means by which said storage base means is resiliently biased upwardly to thereby bias said plurality of covering materials in the likewise upward direction such as to insure that the uppermost one of said plurality of covering materials is positioned at said fixed level.

10. The sewing system according to claim 9, wherein said covering material storage means further includes a container in which said plurality of covering materials are to be piled with one another vertically, wherein said storage base means comprises a container receiving member so dimensioned as to accommodate and receive said container therein, wherein said spring means comprises at least one guide rod fixedly provided at said base means and at least one coil spring wound around said guide rod, and wherein said container receiving member is connected to said at least one coil spring, to thereby resiliently bias both said container and container receiving member in an upward direction such as to insure that the uppermost one of said plurality of covering material is always positioned at the fixed level.

11. The sewing system according to claim 1, wherein said vertical transfer mechanism comprises: at least one elevation cylinder fixedly provided at said base means; a catcher plate connected to said at least one elevation cylinder; and a catching device mounted at said catcher plate, said catching device being operable to effect a hitched engagement with an upper surface of said uppermost one of said plurality of said covering materials, with such an arrangement that operation of said at least one elevation cylinder causes vertical displacement of said catcher plate towards and away from said covering material storage means in order to catch said uppermost one of said plurality of said covering materials through operation of said catching device, to thereby secure said one covering material, and then raise said one covering material to said level above said base means.

12. The sewing system according to claim 11, wherein said catching device comprises a pair of spaced-apart cylinders disposed on said catcher plate and two sets of plural catching needles, each being connected to the respective said pair of spaced-apart cylinders, wherein operating said pair of spaced-apart cylinders in normal direction causes said two sets of plural catching needles to move away from each other in order to effect said hitched engagement with the upper surface of said uppermost one of said plurality of said covering materials, whereas on the other hand, operating said pair of spaced-apart cylinders in reverse direction causes said two sets of plural catching needles to move toward each other in order to release said uppermost one of said plurality of said covering materials from said hitched engagement.

13. The sewing system according to 11, wherein said plurality of said covering members are each of such a type wherein the upper surface thereof are in a gigged or raised state.

14. The sewing system according to 12, wherein said two sets of plural catching needles are inclined outwardly of said catcher plate in a direction opposite to each other.

15. The sewing system according to claim 1, wherein said horizontal transfer mechanism comprises: a transfer plate on which said one covering material is to be received, said transfer being slidably mounted on said base means such as to be movable in a horizontal direction between said vertical transfer mechanism and said sewing machine, and a cylinder for causing movement of said transfer plate in said horizontal direction, and wherein, by operation of said cylinder, said transfer plate is moved to said vertical transfer mechanism to receive said one covering material thereon and withdrawn toward said sewing machine to bring said one covering material to said sewing position.

16. The sewing system according to claim 1, which further comprises a covering material locating/setting mechanism which is so arranged on said base means as to be disposed in a neighborhood of said sewing machine and at one part of said horizontal transfer mechanism, said covering material locating/setting mechanism being operable to cause normal and reverse displacement of said one covering material which has been transferred to said sewing position by said horizontal transfer mechanism, to thereby determine a length of said one covering material, and then locate and set said one covering material at a proper position according to the length of said one covering material, so that said one covering material is sewn with said anchor member from said sewing start point.

17. The sewing system according to claim 16, wherein said covering material locating/setting mechanism comprises: a sensor means for detecting one end of said one covering material transferred by said horizontal transfer mechanism to said sewing position, said sensor means being provided at a point adjacent to said transfer mechanism and at a predetermined distance from said sewing start point; a roller means for feeding said one covering material in a direction toward and away from said sensor means; and a motor operable normally and reversely to actuate said roller means so as to feed said one covering material in said direction, so that when said motor operates normally to cause feeding of said one covering material towards said sensor means via said roller means, said sensor means detects one end of said covering material to determine the length of said covering material, and responsive to data from said sensor means, said motor operates reversely to cause feeding of said one covering material towards said proper position according to the length thereof, so that said one covering material is sewn with said anchor member from said sewing start point.

18. The sewing system according to claim 17, wherein said roller means comprises: an upper drive roller disposed above said base means, said upper drive roller being connected to an output shaft of said motor; a lower auxiliary roller disposed under said base means at a point right below said upper drive roller; a cylinder means fixedly provided below said base means, said cylinder means being connected to said lower auxiliary roller, and wherein, in operation, said lower auxiliary roller is moved by said cylinder means towards said upper drive roller, thereby grasping a part of said covering material, and then, said motor operates to rotate said upper drive roller to thereby cause feeding of said covering material between said sensor means and said proper position.

19. The sewing system according to claim 1, wherein said discharging mechanism comprises: a roller means for feeding said said resulting sewn product of covering material and anchor member in a direction toward said discharging area; and a motor operable to actuate said roller means to cause feeding of said one covering means in said direction.

20. The sewing system according to claim 19, wherein said roller means comprises: an upper drive roller disposed above said base means, said upper drive roller being connected to an output shaft of said motor; a lower auxiliary roller disposed under said base means at a point right below said upper drive roller; a cylinder means fixedly provided below said base means, said cylinder means being connected to said lower auxiliary roller, and wherein, in operation, said lower auxiliary roller is moved by said cylinder means towards said upper drive roller, thereby grasping a part of said resulting sewn product of the covering material and the anchor member, and then, said motor operates to rotate said upper drive roller to thereby cause feeding of said resulting sewn product of the covering material and the anchor member out of said base means to said discharging area.

* * * * *